US011118145B2

(12) United States Patent
Smith et al.

(10) Patent No.: US 11,118,145 B2
(45) Date of Patent: Sep. 14, 2021

(54) STAIN AND ODOR TREATMENT

(71) Applicant: Harris Research, Inc., Nashville, TN (US)

(72) Inventors: Christopher Wayne Smith, Logan, UT (US); Adnan Rashid Manassra, San Jose, CA (US)

(73) Assignee: Harris Research, Inc., Nashville, TN (US)

( * ) Notice: Subject to any disclaimer, the term of this patent is extended or adjusted under 35 U.S.C. 154(b) by 0 days.

(21) Appl. No.: 16/555,962

(22) Filed: Aug. 29, 2019

(65) Prior Publication Data

US 2019/0382695 A1 Dec. 19, 2019

Related U.S. Application Data

(62) Division of application No. 15/448,412, filed on Mar. 2, 2017, now Pat. No. 10,465,149.

(60) Provisional application No. 62/302,666, filed on Mar. 2, 2016.

(51) Int. Cl.

| | |
|---|---|
| ***C11D 11/00*** | (2006.01) |
| ***C11D 17/06*** | (2006.01) |
| ***C11D 7/12*** | (2006.01) |
| ***C11D 7/32*** | (2006.01) |
| ***C11B 9/00*** | (2006.01) |
| ***C11D 3/00*** | (2006.01) |
| ***C11D 3/10*** | (2006.01) |
| ***C11D 3/33*** | (2006.01) |
| ***C11D 3/50*** | (2006.01) |

(52) U.S. Cl.

CPC ..... *C11D 11/0017* (2013.01); *C11B 9/0061* (2013.01); *C11D 3/0068* (2013.01); *C11D 3/10* (2013.01); *C11D 3/33* (2013.01); *C11D 3/50* (2013.01); *C11D 7/12* (2013.01); *C11D 7/3245* (2013.01); *C11D 11/0064* (2013.01); *C11D 17/06* (2013.01)

(58) Field of Classification Search

None

See application file for complete search history.

(56) References Cited

U.S. PATENT DOCUMENTS

| | | | | |
|---|---|---|---|---|
| 4,741,856 | A | 5/1988 | Taylor et al. | |
| 5,780,404 | A * | 7/1998 | Bacon | C11D 3/50 510/101 |
| 2003/0199412 | A1* | 10/2003 | Gupta | C11D 3/1253 510/285 |
| 2005/0065054 | A1 | 3/2005 | Manske et al. | |
| 2006/0019859 | A1 | 1/2006 | Duran et al. | |
| 2007/0072787 | A1* | 3/2007 | Hazenkamp | C11D 3/3932 510/446 |
| 2007/0083998 | A1* | 4/2007 | Leskowicz | C11D 7/10 8/115.51 |
| 2009/0032063 | A1* | 2/2009 | Haas | C11D 3/33 134/18 |
| 2009/0081755 | A1* | 3/2009 | Schmiedel | C11D 3/50 435/183 |
| 2009/0269297 | A1 | 10/2009 | Conover, Sr. | |
| 2009/0313766 | A1* | 12/2009 | Falk | D06L 4/27 8/142 |
| 2013/0005635 | A1* | 1/2013 | Bianchetti | C11D 3/3942 510/302 |
| 2013/0283560 | A1* | 10/2013 | Durrant | C11D 17/0008 15/320 |

FOREIGN PATENT DOCUMENTS

| | | |
|---|---|---|
| CN | 1361817 | 7/2002 |
| CN | 1863898 | 11/2006 |
| CN | 101316922 | 12/2008 |
| CN | 105120961 | 12/2015 |
| EP | 0 241 962 | 10/1987 |
| EP | 0 622 451 | 2/1994 |
| WO | 03033636 | 4/2003 |

OTHER PUBLICATIONS

European Search Report dated Sep. 9, 2019 of European Patent Application No. 17760848.6.

Non-Final Office Action dated Jan. 11, 2019 of corresponding U.S. Appl. No. 15/448,412.

Notice of Allowance dated Jun. 5, 2019 of corresponding U.S. Appl. No. 15/448,412.

Corrected Notice of Allowability dated Aug. 12, 2019 of corresponding U.S. Appl. No. 15/448,412.

Belle Aire Creations, "Total Malodor Managment", http://www.belle-aire.com/omcomplex.html, downloaded on Jun. 2, 2017, know about as early as Feb. 17, 2016, 2 pages.

PCT/US2017/020507, "Notification of Transmittal of the International Search Report and the Written Opinion of the International Searching Authority, or the Declaration," dated Jun. 12, 2017.

Chinese Office Action dated Oct. 13, 2020 of corresponding Chinese Patent Application No. 201780014976.6.

* cited by examiner

*Primary Examiner* — Katie L. Hammer

(74) *Attorney, Agent, or Firm* — Bradley Arant Boult Cummings LLP

(57) ABSTRACT

A stain and odor treatment composition and method of use is provided. The composition is a powdered pre-application composition for treatment of odor and/or stains in textiles. The composition includes a powdered oxidizing agent, a powdered buffering agent, and an odor-modifying agent. In one embodiment the oxidizing agent may be at least 50 weight percent of the composition. In another embodiment the buffering agent may be between about 10 weight percent and about 30 weight percent of the composition. In one embodiment, the method includes providing a powdered buffering agent, combining an odor-modifying agent with the powdered buffering agent, and mixing the odor-modifying agent with the powdered buffering agent. The method of use may include the steps of combining the powdered pre-application composition with water, mixing the powdered pre-application composition with the water to form a cleaning solution, and applying the cleaning solution to a textile.

13 Claims, 2 Drawing Sheets

STAIN AND ODOR TREATMENT

CROSS-REFERENCES TO RELATED APPLICATIONS

This application claims the benefit of U.S. patent application Ser. No. 15/448,412 filed on Mar. 2, 2017 and which was at the time of filing of this Application, and further claims the benefit of Provisional Patent Application No. 62/302,666 filed on Mar. 2, 2016, which is incorporated herein by reference.

FIELD

This application relates generally to floor cleaning, and more particularly relates to floor-cleaning compounds.

BACKGROUND

In the cleaning industry, many different cleaning compounds, such as soaps, detergents, and surfactants, can be used to treat contaminants on a textile. For example, a practitioner may drive a portable cleaning vehicle to a site to perform a carpet-cleaning task. Upon arriving at the site, the practitioner may spend time measuring and/or preparing specific compounds for specific cleaning treatments. In order to effectively treat certain stains and odors (e.g., pet urine), practitioners may need to prepare cleaning solutions that have multiple active ingredients, thus further complicating and extending the duration of the on-site preparation work.

SUMMARY

A method of manufacturing a stain and odor treatment composition is provided. In one embodiment, the method includes providing a powdered buffering agent, combining an odor-modifying agent with the powdered buffering agent, and mixing the odor-modifying agent with the powdered buffering agent. The method also includes combining a powdered oxidizing agent with the powdered buffering agent and the odor-modifying agent, mixing the powdered oxidizing agent with the powdered buffering agent and the odor-modifying agent, and sealing the intermixed powdered buffering agent, the odor-modifying agent, and the powdered oxidizing agent in powdered form in a container substantially isolated from moisture.

In a further embodiment, the mixing the powdered oxidizing agent with the powdered buffering agent and the odor-modifying agent further comprises mixing until the pre-application composition has a moisture content of less than 10%, or less than 4%. In one embodiment, providing the powdered buffering agent comprises intra-mixing particles of the powdered buffering agent.

The method may also include combining and mixing a chelating agent before sealing the intermixed agents in the container. The chelating agent may be selected from a group including ethylene di-amine tetra-acetic ("EDTA"), nitrileotriacetic acid ("NTA"), ethylenediaminetriacetic acid ("ED3A"), N,N'-ethylenediaminediacetic acid ("N,N'-EDDA"), nitrilotris methylenephosphonic acid ("NTMP"), diethylenetriaminepentacetic acid ("DTPA"), iminodiacetic acid ("IDA"), N-(1,2-dicarboxyethylene)-D,L-asparagine acid ("IDS"), polyaspartic acid ("DS") {CAS No. 181828-06-8}, ethylene diamine-N,N'-disuccinic acid ("EDDS") {CAS No. 144538-83-0}, tetrasodium of N,N-bisCcarboxymethyl) glutamic acid ("GLDA") {CAS No. 51981-21-6}, methylglcinediacetic acid, also known as glycine-N, N-diacetic acid ("MGDA"), Trilon M Granules SG, and trilon M powder.

In one embodiment, the odor-modifying agent is in powdered form, alternatively, it is in liquid form. In one embodiment, the intermixed odor-modifying agent and the powdered buffering agent are substantially dry to the touch. Furthermore, the method includes spraying the odor-modifying agent over the powdered buffering agent so as to not over-saturate the powdered buffering agent with the liquid odor-modifying agent.

In one embodiment, the powdered buffering agent and the odor-modifying agent are mixed for at least 30 minutes before combining the powdered oxidizing agent with the powdered buffering agent and the odor-modifying agent. In one embodiment, the powdered buffering agent, the odor-modifying agent, and the powdered oxidizing agent are mixed for at least 15 minutes before sealing the powdered buffering agent, the odor-modifying agent, and the powdered oxidizing agent in the container.

In another embodiment, the powdered buffering agent is selected from a group consisting of sodium carbonate, potassium carbonate, lithium carbonate, rubidium carbonate, cesium carbonate, and ammonium carbonate. Furthermore, the odor-modifying agent includes an aromatic complex that is selected from a group consisting of Benzaldehyde, Bourgeonal, Cinnamaldehyde, Hexyl Cinnamaldehyde, Citronellal, Hydroxy Citronella, Citral, Cuminaldehyde, Decanal, Eugenol, Geraniol, Heptanal, Cis-3-Hexen-1-ol, Hexanal, α-Ionone, β-Ionone, γ-Ionone, Lyral, Nonanaldehyde, Octanaldehyde, Valeraldehyde, Perillaldehyde, Piperanal, Vanillin, para tert-amyl cyclohexanone, ortho tert-butyl cyclohexanol, 3-cyclohexene-1-carboxaldehyde 4-(4-hydroxy-4-methylpentyl), alpha-methyl-4-(1-methylethyl) benzenepropanal, para tert-butyl-alpha-methyl dihydrocinnamic aldehyde, and 4-tert-butyl cyclohexanol.

A powdered pre-application composition is also provided. In one embodiment, the powdered pre-application composition includes a powdered oxidizing agent, a powdered buffering agent, and an odor-modifying agent. In one embodiment, the odor-modifying agent is liquid before being combined with the powdered oxidizing agent and the powdered buffering agent. In another embodiment, the powdered pre-application composition includes a powdered chelating agent.

In one embodiment, the oxidizing agent comprises at least about 50 weight percent of the composition, and the buffering agent comprises between about 10 weight percent and about 30 weight percent of the composition.

A method of using the powdered pre-application composition is also provided. The method includes providing a powdered pre-application composition comprising a powdered oxidizing agent, a powdered buffering agent, and an odor-modifying agent, combining the powdered pre-application composition with water, mixing the powdered pre-application composition with the water to form a cleaning solution, and applying the cleaning solution to a textile.

BRIEF DESCRIPTION OF THE DRAWINGS

In order that the advantages of the subject matter of the present disclosure will be readily understood, a more particular description of the subject matter will be rendered by reference to specific embodiments that are illustrated in the appended drawings. Understanding that these drawings depict only typical embodiments of the subject matter of the present disclosure and are not therefore to be considered to be limiting of its scope, the subject matter will be described and explained with additional specificity and detail through the use of the accompanying drawings, in which.

DETAILED DESCRIPTION

Figure 1:
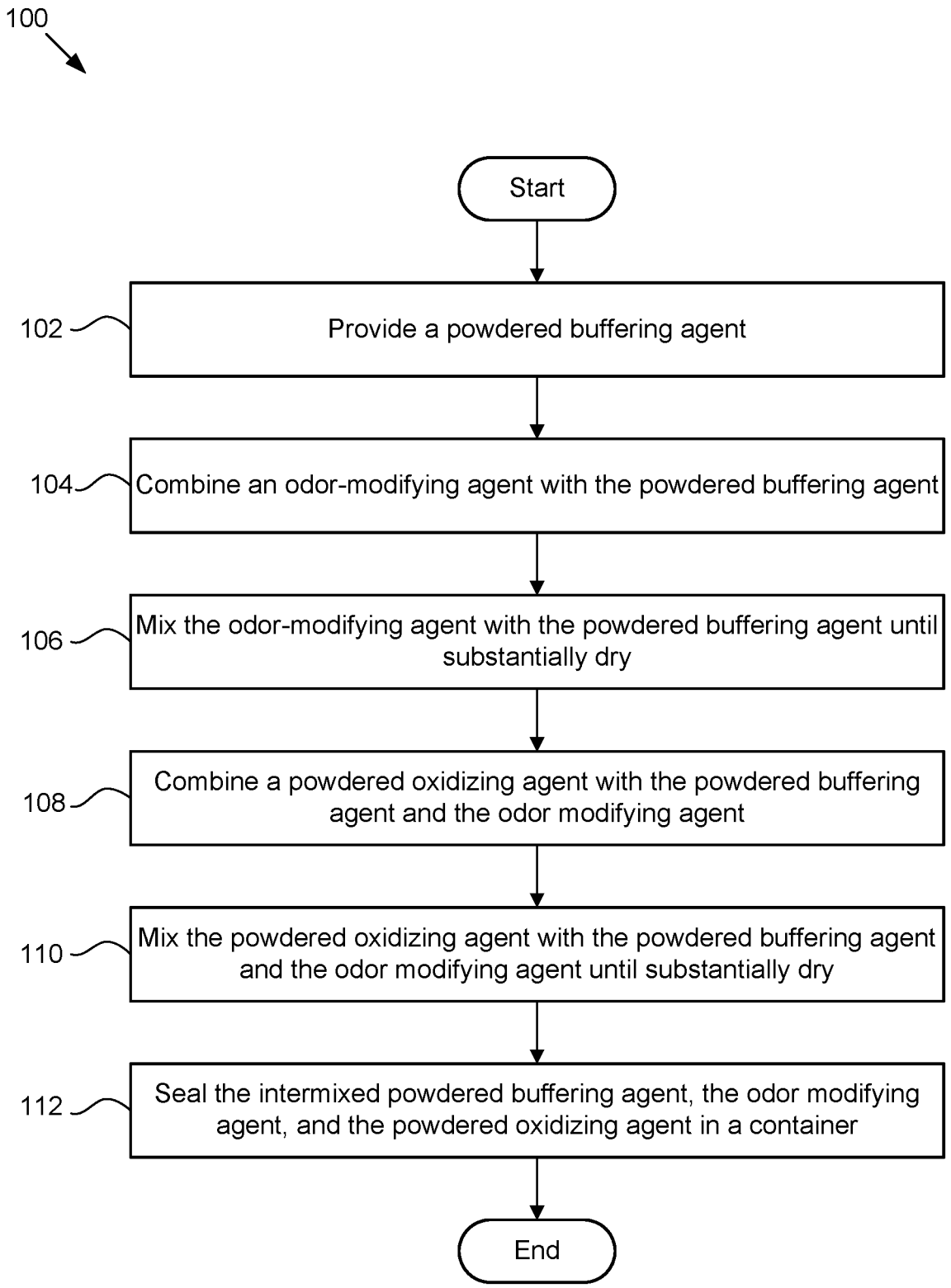
FIG. 1 is a schematic flow chart diagram of a method for manufacturing a powdered pre-application composition for treatment of odor and/or stains in textiles, according to one embodiment.

The subject matter of the present disclosure has been developed in response to the present state of the art in cleaning compositions. Accordingly, the subject matter of the present disclosure has been developed to provide a composition and related methods for treating stains and/or odors in textiles that overcome many or all or some shortcomings in the prior art.

Reference throughout this specification to features, advantages, or similar language does not imply that all of the features and advantages that may be realized with the subject matter of the present disclosure should be or are in any single embodiment of the subject matter. Rather, language referring to the features and advantages is understood to mean that a specific feature, advantage, or characteristic described in connection with an embodiment is included in at least one embodiment of the subject matter of the present disclosure. Thus, discussion of the features and advantages, and similar language, throughout this specification may, but do not necessarily, refer to the same embodiment.

Furthermore, the described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

Similarly, reference throughout this specification to "one embodiment," "an embodiment," or similar language means that a particular feature, structure, or characteristic described in connection with the embodiment is included in at least one embodiment of the subject matter of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the subject matter of the present disclosure, however, absent an express correlation to indicate otherwise, an implementation may be associated with one or more embodiments.

Disclosed herein is a powdered pre-application composition for the treatment of odors and/or stains in textiles. The powdered pre-application composition is specifically manufactured, as described below with reference to FIG. 1, to be in an isolated, pre-packaged, powdered form and is configured to be specifically applied, as described below with FIG. 2, to treat various contaminants in textiles (e.g., odor molecules). The powdered pre-application composition includes a powdered oxidizing agent, a powdered buffering agent, and an odor-modifying agent. The powdered pre-application composition may optionally include a powdered chelating agent. Each of these components is described below in greater detail.

The powdered oxidizing agent includes oxidizer molecules that, upon application to a textile, react with contaminant molecules in the textile to yield oxidized contaminant molecules that are extractible from the textile and/or are non-malodorous. In other words, the oxidizing agent oxidizes stain molecules to promote the extraction (e.g., removal) of the stain molecules and oxidizes odor molecules to promote the extraction and/or conversion of the odor molecules into non-malodorous compounds. For example, odor molecules may be oxidized and rendered non-malodorous by the oxidizing agent. The oxidizing agent, according to one embodiment, may be relatively stable and non-reactive in the isolated and pre-application composition. The oxidizing agent may activated, as described below with reference to FIG. 2, by combining the powdered pre-application composition with water.

In one embodiment, the oxidizing agent is sodium percarbonate. In other embodiments, the oxidizing agent may be potassium percarbonate, carbamide peroxide (e.g., urea hydrogen peroxide), or other oxidizers.

The powdered buffering agent is included in the powdered pre-application composition to increase and subsequently stabilize the pH of a cleaning solution that is produced upon mixing the powdered pre-application composition with water before applying the cleaning solution to a textile. In one embodiment, the buffering agent helps to regulate the activation and reaction of the oxidizing agent.

In one embodiment, the powdered buffering agent is a carbonate salt in powder form. For example, the powdered buffering agent may include alkali metals, such as sodium and potassium that are the cations of the carbonate salt. Other examples of possible compounds that may be used as the powdered buffering agent include lithium carbonate, rubidium carbonate, cesium carbonate, and ammonium carbonate, among others. In one embodiment, sodium carbonate may be used as the powdered buffering agent and, upon mixing the powdered pre-application composition with water to produce a cleaning solution (see below with reference to FIG. 2), the pH of the cleaning solution may stabilize between about 8 and 12. In another embodiment, the buffering agent may help the pH of the cleaning solution to stabilize between about 9 and 10. The alkalinity of the cleaning solution may facilitate the activation and reaction of the oxidizing agent to promote the oxidation of contaminant molecules, such as pet urine or other odor molecules, thus rendering them non-malodorous. In some embodiments, the pH of the cleaning solution may be limited by the type of textile that is to be cleaned. For example, certain nylon carpets may begin to decompose or otherwise deteriorate in highly basic solutions.

The odor-modifying agent is specifically configured to entrap and/or react with odor molecules and chemically modify the odor molecules to neutralize the malodorous functional groups of the odor molecules. In one embodiment, the odor-modifying agent includes a molecular encapsulator compound. The molecular encapsulator compound encapsulates and neutralizes many malodorous molecules, especially those derived from sulfur or ammonia groups (e.g., sulfides, thiazoles, amines). In one embodiment, the molecular encapsulator is the compound Ordenone, which is distributed by Belle Aire Fragrances.

The odor-modifying agent, according to one embodiment, also includes one or more aromatic complex that facilitate the neutralization of odor molecules in the vapor phase and/or odors caused by molecules that have fatty acids. Examples of aromatic complexes that may be employed include:Benzaldehyde, Bourgeonal, Cinnamaldehyde, Hexyl Cinnamaldehyde, Citronellal, Hydroxy Citronella, Citral, Cuminaldehyde, Decanal, Eugenol, Geraniol, Heptanal, Cis-3-Hexen-1-ol, Hexanal, α-Ionone, β-Ionone, γ-Ionone, Lyral, Nonanaldehyde, Octanaldehyde, Valeraldehyde, Perillaldehyde, Piperanal, Vanillin, para tert-amyl cyclohexanone, ortho tert-butyl cyclohexanol, 3-cyclohexene-1-carboxaldehyde 4-(4-hydroxy-4-methylpentyl), alpha-methyl-4-(1-methylethyl) benzenepropanal, para tert-butyl-alpha-methyldihydrocinnamic aldehyde, and 4-tert-butyl cyclohexanol, among others.

The aromatic complex operates through a process of chemical/electron charge exchange, and this works with Ordenone to eliminate odors from lower fatty acids, such as isovaleric acid. Malodorous molecules have a tendency to either donate or accept protons due to the presence of polar groups on these molecules. On smaller molecules, a polar group will play an important part of any interaction that can occur with other compositions. Because of this, any exchange of protons with this polar group on a malodorous molecule will temper the malodor's tendency to cause a foul odor.

The functional group on the aromatic complex of the odor-modifying agent also contains polar groups that, when they interact with the malodorous molecules, accept or donate protons, thus causing bond disruptions in the fatty acid. In particular, carbonyl groups as would be present in aldehydes are effective to cause this bond disruption effect. In addition, aldehydes often are associated with pleasant smells, which may make particular aldehydes desirable. Even aldehydes that have offensive odors—such as butyraldehyde—may be effective at causing these bond disruptions, even though the use of foul smelling aldehydes would not be appropriate in some applications of the present invention. In certain applications, the scent associated with the aldehyde used might be irrelevant.

In one embodiment, although the bond disruptions caused by the aromatic complex do not change the identity of the malodorous molecules themselves, the bond disruptions caused by the aromatic complex render fatty acids (or other malodorous molecules) more susceptible to encapsulation by the molecular encapsulator. In other words, the odor-modifying agent does more than provide a masking scent, but rather it eliminates malodorous molecules. Thus, the combination of the molecular encapsulator compound with the one or more aromatic complexes would eliminate malodorous molecules that would otherwise not be eliminated using either the molecular encapsulator compound or the aromatic complexes individually. That is, the advantages of the odor-modifying agent are more than simply adding two individually beneficial components. Additionally, the advantages of the powdered pre-application composition are more than the individual benefits of each of the agents.

In one embodiment, the odor-modifying agent of the powdered pre-application composition is in powdered form. In another embodiment, the odor-modifying agent is in liquid form.

In one embodiment, as mentioned above, the powdered pre-application composition may include a chelating agent or other stabilizing compound. The chelating agent may promote the extraction/removal of contaminant molecules. The chelating agent may also assist in the regulation of the oxidation reaction. In one embodiment, for example, the chelating agent may be ethylene di-amine tetra-acetic acid ("EDTA"). Other examples of the chelating agent include nitrileotriacetic acid ("NTA"), ethyl enediaminetriacetic acid ("ED3A"), N,N'-ethylenediaminediacetic acid ("N,N'-EDDA"), nitrilotris methylenephosphonic acid ("NTMP"), diethylenetriaminepentacetic acid ("DTPA"), iminodiacetic acid ("IDA"), N-(1,2-dicarboxyethylene)-D,L-asparagine acid ("IDS"), polyaspartic acid ("DS") {CAS No. 181828-06-8}, ethylenediamine-N,N'-disuccinic acid ("EDDS") {CAS No. 144538-83-0}, tetrasodium of N,N-bisCcarboxymethyl) glutamic acid ("GLDA") {CAS No. 51981-21-6}, methylglcinediacetic acid, also known as glycine-N, N-diacetic acid ("MGDA"), Trilon M Granules SG, and trilon M powder, among others.

In one embodiment, the powdered oxidizing agent is at least about 50 weight percent of the powdered pre-application composition. In one embodiment, the weight percent of the powdered oxidizing agent in the powdered pre-application composition is between about 50% and about 90%. In one embodiment, the weight percent of the powdered buffering agent in the powdered pre-application composition is between about 10% and about 30%. In one embodiment, the weight percent of the odor-modifying agent in the powdered pre-application composition is between about 0.1% and about 10%. In one embodiment, the weight percent of the chelating agent in the powdered pre-application composition is between about 0.0% and about 20%. In one non-limiting example, when preparing 100 lbs. of the composition, the composition may include 19 lbs. of buffering agent, 3 lbs. of odor-modifying agent, 2 lbs. of chelating agent, and 76 lbs. of oxidizing agent.

FIG. 1 is a schematic flow chart diagram of one embodiment of a method 100 for manufacturing the powdered pre-application composition for treatment of odor and/or stains in textiles. The method 100 includes providing 102 the powdered buffering agent and subsequently combining 104 the odor-modifying agent with the powdered buffering agent. The method 100 further includes mixing 106 the odor-modifying agent with the powdered buffering agent and subsequently combining 108 the powdered oxidizing agent with the powdered buffering agent and the odor-modifying agent. Still further, the method 100 includes mixing 110 the powdered oxidizing agent with the powdered buffering agent and the odor-modifying agent and sealing 112 the intermixed powdered buffering agent, the odor-modifying agent, and the powdered oxidizing agent in powdered form in a container substantially isolated from moisture.

In one embodiment, providing the powdered buffering agent includes intra-mixing particles of the powdered buffering agent. In other words, the particles of the powdered buffering agent are placed into a mixer, such as a powder blender or other industrial particulate mixer, and are mixed initially before combining other compounds. The method 100 may also include combining and mixing a chelating agent before sealing the intermixed agents in the container.

The product of the method 100 is the pre-application composition in powder form. As mentioned above, while the odor-modifying agent, upon combining and mixing, may be in liquid or powder form, the product of the method 100 is the composition in powder form. In one embodiment, in which the odor-modifying agent is in liquid form, the step of combining 104 the odor-modifying agent with the powdered buffering agent may be accomplished by spraying or pouring the liquid odor-modifying agent over the powdered buffering agent. In one embodiment, the mixing step 104 also includes mixing the combination until the mixture is substantially dry. In a further embodiment, the mixing is performed in an open-to-air container, or in an otherwise ambient environment, until the mixture achieves less than 10% moisture content. In yet a further embodiment, the mixing is performed until the mixture achieves less than 4% moisture content. In another embodiment, the mixing and drying may be performed with added heated dry air.

After combining (e.g., spraying, pouring) 104, the powdered buffering agent absorbs the liquid odor-modifying agent so that, after mixing 106, the intermixed powdered buffering agent and the odor-modifying agent is in powder form. In one embodiment, the intermixed powdered buffering agent and the odor-modifying agent is dry to the touch. In one embodiment, the combining of the liquid odor-modifying agent is carefully controlled to not over-saturate the powdered buffering agent with the liquid odor-modifying agent.

In one embodiment, the powdered buffering agent and the odor-modifying agent are mixed for at least 30 minutes before combining the powdered oxidizing agent with the powdered buffering agent and the odor-modifying agent. Thus, the powdered buffering agent and the odor-modifying agent can be mixed between about 30 minutes and about 48 hours, depending on the environmental conditions and the mixer capabilities, to ensure the powdered buffering agent and the odor-modifying agent are sufficiently mixed (and in the case where liquid odor-modifying agent is employed, ensuring the mix is dry to the touch). As with step 104, the mixing here may be performed until the mixture is substantially dry. For example, the mixing is performed until the moisture content is less than 10%. In further embodiments, the mixing is performed until the moisture content is less than 4%. Beneficially, by decreasing the moisture content, the shelf life of the pre-application cleaning composition is increased.

In one embodiment, the powdered buffering agent, the odor-modifying agent, and the powdered oxidizing agent are mixed 110 for at least 15 minutes before sealing 112 the powdered buffering agent, the odor-modifying agent, and the powdered oxidizing agent in the container. In another embodiment, the powdered buffering agent, the odor-modifying agent, and the powdered oxidizing agent are mixed 110 between about 15 minutes and about 2 hours before sealing 112 the powdered buffering agent, the odor-modifying agent, and the powdered oxidizing agent in the container. The same mixing time may be employed upon adding the optional chelating agent but before sealing the agents within the container. In one embodiment, the container is a heat-sealed bag that prevents the composition from being exposed to moisture.

Figure 2:
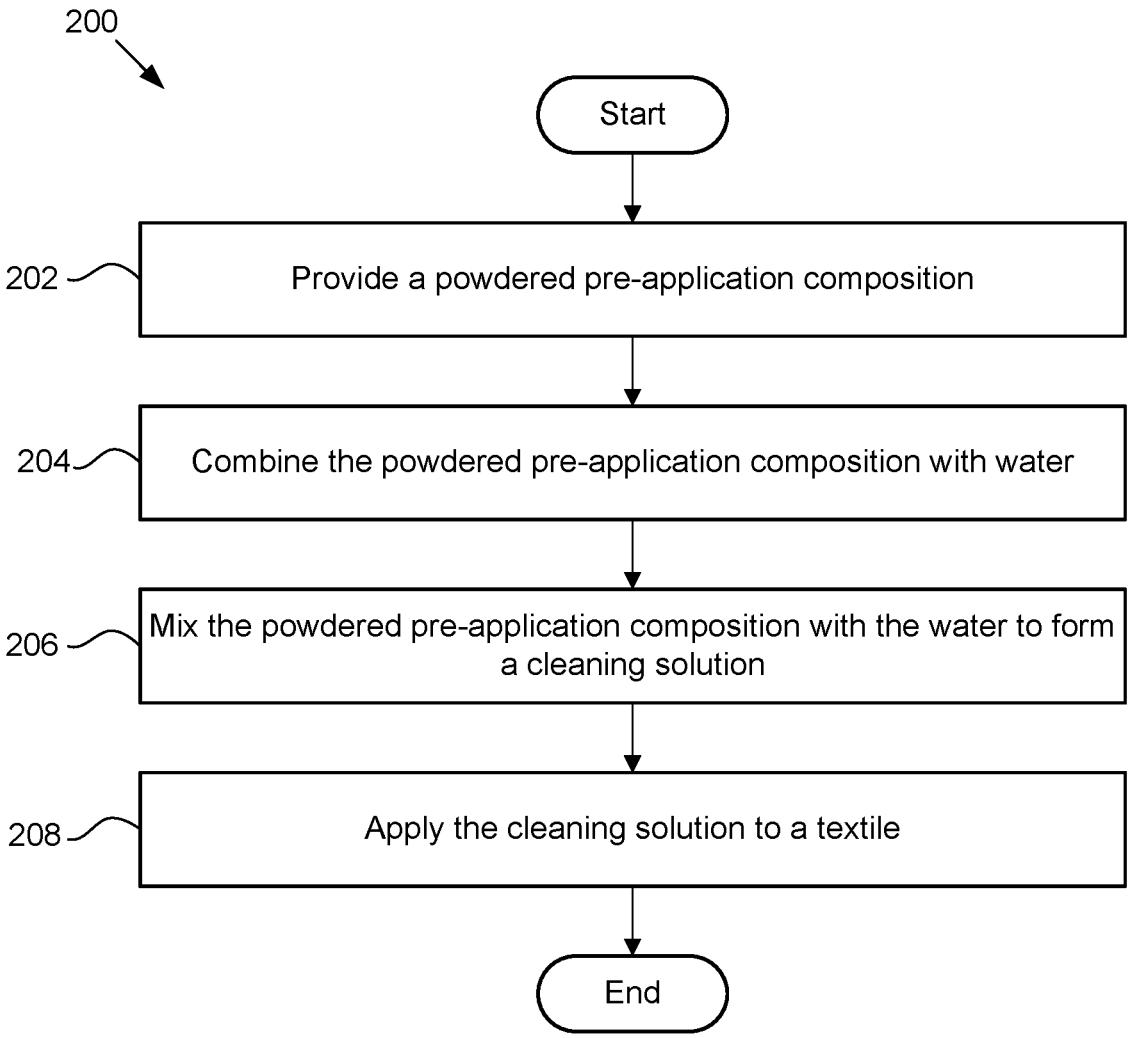
FIG. 2 is a schematic flow chart diagram of a method for using a powdered pre-application composition for treating odor and/or stains in textiles, according to one embodiment.

FIG. 2 is a schematic flow chart diagram of one embodiment of a method 200 for using a powdered pre-application composition for treating odor and/or stains in textiles, according to one embodiment. The method 200 includes providing 202 a powdered pre-application composition that includes a powdered oxidizing agent, a powdered buffering agent, and an odor-modifying agent. The method 200 further includes combining 204 the powdered pre-application composition with water, mixing 206 the powdered pre-application composition with the water to form a cleaning solution, and applying 208 the cleaning solution to a textile. The application of the cleaning solution to the textile may be before a standard carpet cleaning procedure, after a standard carpet cleaning procedure, or independent of a standard carpet cleaning procedure. The application of the cleaning solution may be limited to the areas of the textile that have been permeated with odor molecules. In one embodiment, the user may use a cloth to dab the affected area of the textile with the solution, the user may pour the solution on the affected area of the textile, or the user may spray the area with the solution. In another embodiment, a cleaning device or a cleaning applicator may be employed to apply the solution to the affected area of the textile.

After the solution has soaked the affected areas of the textile, the dissolved oxidizer reacts with the odor molecules and oxidizes them into non-malodorous compounds. In addition, the odor-modifying agent reacts with the odor molecules to entrap and/or react with odor molecules and chemically modify the odor molecules to neutralize the malodorous functional groups of the odor molecules. Additional details regarding the reaction chemistry of the oxidizing agent and the odor-modifying agent are included above.

By maintaining the agents (e.g., the compounds of the powdered pre-application composition) isolated from the environment in powdered form, the activation and reaction strength of the compounds (e.g., the oxidizing power of the oxidizing agent and/or the modifying power of the odor-modifying agent) are preserved until a practitioner is ready to apply the solution to the textile. Additionally, because the composition is pre-packaged and pre-combined, the practitioner does not have to spend extra time measuring and combining active ingredients on site. Instead, the powdered pre-application composition is simply mixed with water and applied to the textile. As mentioned above, in addition to eliminate malodorous compounds, composition also facilitates the removal/extraction of stain molecules from the textile.

In one embodiment, the powdered composition is mixed with water in the range of between about 5 seconds and 5 minutes before applying the cleaning solution to the textile. In another embodiment, the composition is mixed in the range of between about 10 seconds and 1 minute before applying the solution to the textile. In one embodiment, the cleaning solution should be applied to the textile within 4 hours of combining/mixing the powdered pre-application composition with water in order to maximize the effectiveness of the active ingredients. In one embodiment, between about 1 and 16 ounces of the powdered pre-application composition is mixed with 1 gallon of water. In another embodiment, about 6 ounces of the powdered pre-application composition is mixed with 1 gallon of water. As mentioned above, the pH of the cleaning solution may be in the range of between 8 and 12.

In the above description, the term "combining" means partially or completely joining as with chemical bonds, as well as by simply mixing the components mechanically without the components being chemically bound. In addition, the term "compound," as used throughout the present disclosure, refers to components combined with our without chemical bonding; thus, components of a "compound" might be partially or completely bonded chemically, or they might be mechanically combined only.

In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C; or some other suitable combination. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Aspects of the embodiments may be described above with reference to schematic flowchart diagrams and/or schematic block diagrams of methods, apparatuses, and systems according to embodiments of the disclosure. The schematic flowchart diagrams and/or schematic block diagrams in the figures illustrate the architecture, functionality, and operation of possible implementations of apparatuses, and systems according to various embodiments of the present disclosure. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated figures.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. A powdered pre-application composition for treatment of odor and/or stains in textiles, the powdered pre-application composition comprising:

a powdered oxidizing agent selected from sodium percarbonate, potassium percarbonate, carbamide peroxide, or combinations thereof, wherein the powdered oxidizing agent comprises at least about 50 weight percent of the powdered pre-application composition;

a powdered buffering agent comprising between about 10 weight percent and about 30 weight percent of the powdered pre-application composition; and an odor-modifying agent configured to neutralize a malodorous functional group of an odor molecule.

2. The powdered pre-application composition of claim 1, wherein the odor-modifying agent is liquid before being combined with the powdered oxidizing agent and the powdered buffering agent.

3. The powdered pre-application composition of claim 1, further comprising a powdered chelating agent.

4. A method for treating odor and/or stains in textiles, the method comprising:

providing a powdered pre-application composition comprising a powdered oxidizing agent, a powdered buffering agent, and an odor-modifying agent configured to neutralize a malodorous functional group of an odor molecule, wherein the powdered oxidizing agent is selected from sodium percarbonate, potassium percarbonate, carbamide peroxide, or combinations thereof and the powdered oxidizing agent comprises at least about 50 weight percent of the powdered pre-application composition, wherein the powdered buffering agent comprises between about 10 weight percent and about 30 weight percent of the powdered pre-application composition;

combining the powdered pre-application composition with water;

mixing the powdered pre-application composition with the water to form a cleaning solution; and applying the cleaning solution to a textile.

5. The powdered pre-application composition of claim 1, wherein the odor-modifying agent comprises an aromatic complex selected from the group consisting of Benzaldehyde, Bourgeonal, Cinnamaldehyde, Hexyl Cinnamaldehyde, Citronellal, Hydroxy Citronella, Citral, Cuminaldehyde, Decanal, Eugenol, Geraniol, Heptanal, Cis-3-Hexen-1-ol, Hexanal, α-Ionone, β-Ionone, γ-Ionone, Lyral, Nonanaldehyde, Octanaldehyde, Valeraldehyde, Perillaldehyde, Piperanal, Vanillin, para tert-amyl cyclohexanone, ortho tert-butyl cyclohexanol, 3-cyclohexene-1-carboxaldehyde 4-(4-hydroxy-4-methylpentyl), alpha-methyl-4-(1-methylethyl) benzenepropanal, para tert-butyl-alpha-methyldihydrocinnamic aldehyde, and 4-tert-butyl cyclohexanol.

6. The powdered pre-application composition of claim 1, wherein the powdered buffering agent is selected from a group consisting of sodium carbonate, potassium carbonate, lithium carbonate, rubidium carbonate, cesium carbonate, and ammonium carbonate.

7. The powdered pre-application composition of claim 1, wherein the powdered oxidizing agent is sodium percarbonate.

8. The powdered pre-application composition of claim 3, wherein the powdered chelating agent is selected from the group consisting of ethylene di-amine tetra-acetic ("EDTA"), nitrileotriacetic acid ("NTA"), ethylenediaminetriacetic acid ("ED3A"), N,N'-ethylenediaminediacetic acid ("N,N'-EDDA"), nitrilotris methylenephosphonic acid ("NTMP"), diethylenetriaminepentacetic acid ("DTPA"), iminodiacetic acid ("IDA"), N-(1,2-dicarboxyethylene)-D, L-asparagine acid ("IDS"), polyaspartic acid ("DS") {CAS No. 181828-06-8}, ethylene diamine-N,N'-disuccinic acid ("EDDS") {CAS No. 144538-83-0}, tetrasodium of N,N-bisCcarboxymethyl) glutamic acid ("GLDA") {CAS No. 51981-21-6}, and methylglcinediacetic acid (glycine-N,N-diacetic acid ("MGDA")).

9. The method of claim 4, wherein the mixing step further comprises mixing the powdered pre-application composition with water for about 5 seconds to about 5 minutes.

10. The method of claim 9, wherein the mixing step further comprises mixing the powdered pre-application composition with water for about 10 seconds to about 1 minute.

11. The method of claim 4, wherein the applying step further comprises applying the cleaning solution to the textile within 4 hours of mixing the powdered pre-application composition with water.

12. The method of claim 4, wherein the mixing step further comprises mixing about 1 to about 16 ounces of the powdered pre-application composition with 1 gallon of water.

13. The powdered pre-application composition of claim 1, further comprising a moisture content of less than 10 percent.

* * * * *